US005729801A

United States Patent [19]

Maruyama et al.

[11] Patent Number: 5,729,801

[45] Date of Patent: Mar. 17, 1998

[54] ELECTROPHOTOGRAPHIC APPARATUS AND PROCESS CARTRIDGE

[75] Inventors: Akio Maruyama, Tokyo; Noboru Kashimura, Kawasaki; Toshihiro Kikuchi; Kazushige Nakamura, both of Yokohama; Shoji Amamiya, Kawasaki; Hiroyuki Tanaka, Yokohama, all of Japan

[73] Assignee: Canon Kabushiki Kaisha, Tokyo, Japan

[21] Appl. No.: 697,793

[22] Filed: Aug. 30, 1996

[30] Foreign Application Priority Data

Sep. 1, 1995 [JP] Japan ..... 7-225295

[51] Int. Cl.[6] ..... G03G 15/00

[52] U.S. Cl. ..... 399/159; 430/58

[58] Field of Search ..... 399/159, 174–176; 430/58

[56] References Cited

U.S. PATENT DOCUMENTS

| | | | |
|---|---|---|---|
| 4,514,481 | 4/1985 | Scozzafava et al. | 430/58 |
| 5,112,708 | 5/1992 | Okunuki et al. | 430/31 |
| 5,176,976 | 1/1993 | Kikuchi et al. | 430/58 |
| 5,328,789 | 7/1994 | Nakamori et al. | 430/58 |

FOREIGN PATENT DOCUMENTS

| | | |
|---|---|---|
| 0299502 | 1/1989 | European Pat. Off. . |
| 0576203 | 12/1993 | European Pat. Off. . |
| 0615177 | 9/1994 | European Pat. Off. . |
| 58-184948 | 10/1983 | Japan . |
| 63-149669 | 6/1988 | Japan . |
| 2-146048 | 2/1990 | Japan . |
| 5-224435 | 9/1993 | Japan . |
| 6-123983 | 5/1994 | Japan . |
| 6-266136 | 9/1994 | Japan . |
| 6-317915 | 11/1994 | Japan . |

OTHER PUBLICATIONS

European Search Report.

*Primary Examiner*—William J. Royer

*Attorney, Agent, or Firm*—Fitzpatrick, Cella, Harper & Scinto

[57] ABSTRACT

An electrophotographic apparatus which comprises an electrophotographic photosensitive member, a charging member provided in contact therewith for charging the electrophotographic photosensitive member by being applied with a voltage, a light exposure device, a developing device, and a transfer device, wherein the electrophotographic photosensitive member has a surface layer containing an organic compound having a reduction potential of 0.5 V or lower, and the charging is injection charging.

13 Claims, 1 Drawing Sheet

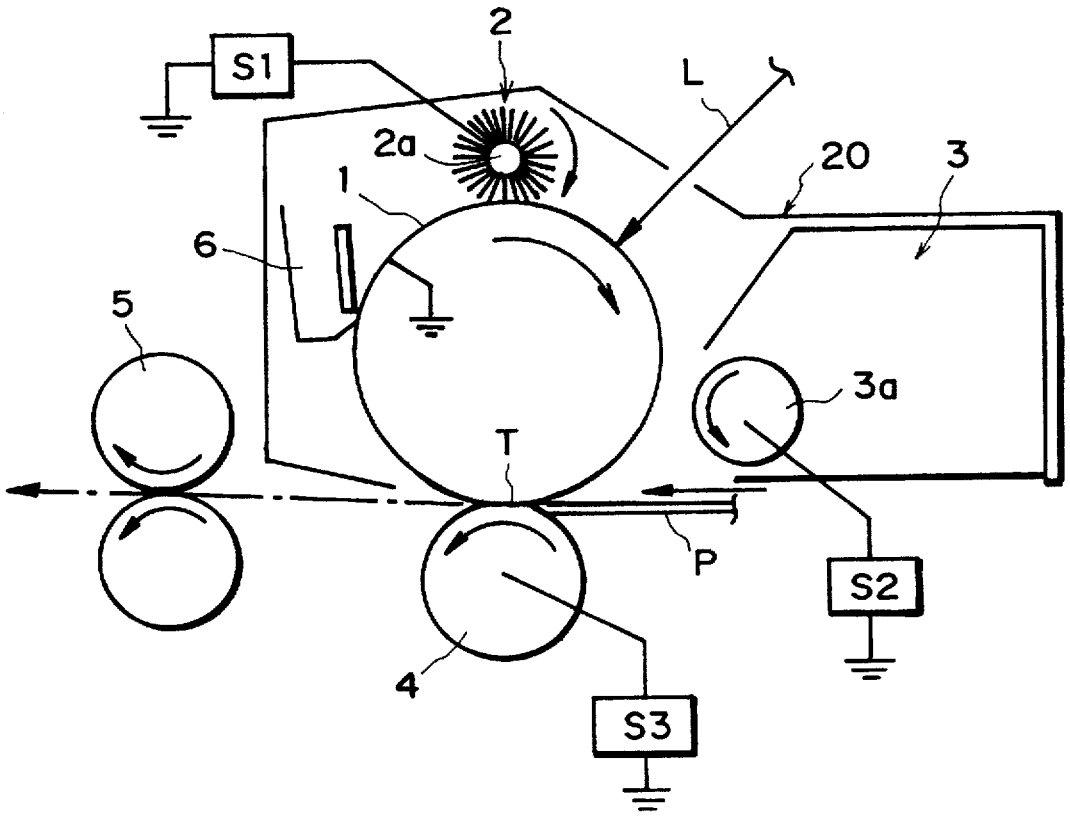
2
S1
L
2a
20
3
1
6
5
3a
T
P
S2
4
S3

ELECTROPHOTOGRAPHIC APPARATUS AND PROCESS CARTRIDGE

BACKGROUND OF THE INVENTION

1. Field of the Invention

The present invention relates to an electrophotographic apparatus, and a process cartridge. More particularly, the present invention relates to an electrophotographic apparatus and a process cartridge employing a specific electrophotographic photosensitive member and specified electric charging member.

2. Related Background Art

Generally, a corona charger is employed as the electric charging means of an electrophotographic apparatus. In recent years, also a contact charging process, where the electrophotographic photosensitive member is charged by applying a voltage to a charging member provided in contact with the photosensitive member, has been practically used because of its small ozone generation and other advantages.

In contact charging as well as in corona charging, charging is conducted by electric discharge. Therefore, even in contact charging, charging is initiated by applying a voltage higher than the discharge-starting voltage. For example, a voltage of at least about 640 V is required for charging an electrophotographic photosensitive member of 25 μm thick with a contact charging roller. When a voltage of about 640 V or higher is applied, discharge starts to rise the surface potential of the photosensitive member, and thereafter the surface potential rises linearly as the applied voltage increases at a gradient of 1. This charge-starting voltage (threshold voltage) is represented by Vth. In other words, the surface potential Vd of the photosensitive member necessary for the electrophotographic process is obtained by applying a DC voltage of (Vd+Vth) to the charging roller. A charging system which uses only DC voltage to charge the electrophotographic photosensitive member is called a DC charging system.

With this DC charging system, however, it is not easy to precisely control the potential of the photosensitive member at a desired potential since the electric resistance of the contact charging member varies with the environmental temperature and humidity, and Vth is determined by the layer thickness of the photosensitive member which changes by abrasion during use. Therefore, for more uniform charging, a so-called AC charging system has been introduced as disclosed in Japanese Patent Laid-Open Application No. 63-149669, in which an oscillating voltage composed of a DC voltage component corresponding to a desired voltage Vd superposed with an AC voltage component having a peak-to-peak voltage of 2×Vth or more is applied to the charging member. With this charging system, the surface potential of the photosensitive member converges to Vd without the influence of the environmental conditions or abrasion of the photosensitive member.

However, even in the above mentioned contact charging system, the voltage required for the charging is higher than the intended surface potential of the photosensitive member and a small amount of ozone is inevitably generated, since the charging mechanism is still based on electric discharge from the charging member through an air gap to the photosensitive member. When the AC charging system is employed for uniform charging, there are such problems as more ozone generation, vibration noise generation due to the electric field of AC voltage, and notable deterioration of the surface of the photosensitive member.

To offset the above disadvantages, EPA 0576203, EPA 0615177, and so forth disclose a charging system which injects electric charge directly from a charging member onto the surface layer of an electrophotographic photosensitive member substantially without electric discharge. However, only a few materials are known for the injection-chargeable electrophotographic photosensitive member, such as those having a silicon carbide layer or a resin layer containing an electroconductive oxide dispersed therein.

SUMMARY OF THE INVENTION

The object of the present invention is to provide an electrophotographic apparatus and a process cartridge enabling effective injection-charging.

The electrophotographic apparatus of the present invention comprises an electrophotographic photosensitive member, a charging member to which a voltage is applied to charge the photosensitive member provided in contact therewith, a light exposure means, a developing means, and a transfer means, wherein the electrophotographic photosensitive member has a surface layer containing an organic compound having a reduction voltage of 0.5 V or lower, and the charging is injection charging.

The process cartridge of the present invention comprises an electrophotographic photosensitive member, a charging member to which a voltage is applied to charge the photosensitive member provided in contact therewith, where the photosensitive member and the charging member are integrated in one unit mountable to and detachable from an electrophotographic apparatus, the photosensitive member has a surface layer containing an organic compound having a reduction voltage of 0.5 V or lower, and the charging is injection charging.

BRIEF DESCRIPTION OF THE DRAWING

The figure shows a schematic constitution of an electrophotographic apparatus employing a process cartridge of the present invention.

DESCRIPTION OF THE PREFERRED EMBODIMENTS

The electrophotographic apparatus or the process cartridge of the present invention comprises an electrophotographic photosensitive member, and a charging member which is provided in contact with a photosensitive member and to which a voltage is applied to charge the photosensitive member, wherein electrophotographic photosensitive member has a surface layer containing an organic compound having a reduction voltage of not higher than 0.5 V, and the charging is conducted by injection charging.

Efficient injection charging is achieved by using the electrophotographic photosensitive member having a specified constitution of the present invention. The use of an organic compound having a reduction potential of 0.5 V or lower in the photosensitive member enables easier uniform dispersion in comparison with metal oxides, and unnecessiates a large-scale production equipment as required in the silicon carbide layer production.

Charging by electric discharge through the air gap and direct injection charging not accompanied by electric discharge can be differentiated by the relationship between the surface potential of the photosensitive member and the voltage applied to the charging member. With the discharge charging, a surface voltage threshold is present. The surface potential of the photosensitive member stays zero while the applied voltage gradually increases from zero volt to several hundred volts, and at the discharge (charge) starting voltage the surface potential starts to increase linearly as the applied voltage increases. On the other hand, with the injection charging, the charge-initiating threshold voltage does not exist or is extremely low, and the surface charge of the photosensitive member increases nearly linearly as the applied voltage increases from zero volt. Accordingly, in the present invention, the injection charging is defined as a charging system in which the surface charging starts at an applied voltage not higher than 100 V without discharge.

In the present invention, any electrophotographic photosensitive member can be employed so long as it contains an organic compound having a reduction potential of not higher than 0.5 V in its surface layer.

The surface layer containing an organic compound having a reduction potential of not higher than 0.5 V can be formed by applying a solution of a binder resin containing the compound and then drying. The surface layer of the present invention may be provided on a photosensitive layer containing a photoconductive material formed on an electroconductive substrate, or it may be an outermost part of the photosensitive layer.

Useful in the present invention are known photosensitive materials, including inorganic photoconductive materials such as Se, $As_2Se_3$, a-Si, CdS, and $ZnO_2$; and organic photoconductive materials such as PVK-TNF, phthalocyanine pigments, and azo pigments. In particular, the photosensitive layer employing an organic photoconductive material, which layer is formed from a mixture of a resin and other compounds, enables the direct incorporation of an organic compound having a reduction potential of not higher than 0.5 V at the surface portion, without forming a separate surface layer of the present invention. Therefore, the photosensitive member of an organic photoconductive material can make the photosensitive member of the present invention very easily with little impairment of the electrophotographic, electric, and chemical properties. Furthermore, among the photosensitive members containing an organic photosensitive material, preferable in the present invention are those of function-separation type in which a charge-generating layer containing a charge-generating substance and a charge-transporting layer containing a charge-transporting substance are present, because of the high potential stability in repeated use. Among the function separation type photosensitive members, preferred are those containing an organic compound having a reduction potential of 0.5 V or lower in the charge-transporting layer provided on a charge-generating layer in view of excellent electrophotographic characteristics such as high potential stability and low residual potential in repeated use.

[Measurement of Reduction Potential]

The reduction potential is measured as follows in the present invention.

The reduction potential is defined as the potential at the current peak in a current-potential curve which is obtained by carrying out potential sweep at a working electrode (platinum) using a potential sweeper, a saturated calomel electrode as the reference electrode and a 0.1N $(n\text{-}Bu)_4N^+ ClO_4^-$ acetonitrile solution. More specifically, a sample is dissolved at a concentration of about 10 mmol % in a 0.1N $(n\text{-}Bu)_4N^+ClO_4^-$ acetonitrile solution. A voltage is applied to the sample solution from a working electrode. A current-potential curve is obtained by measuring the change of the electric current when the voltage is changed linearly from a high potential (zero volt) to a low potential (−1 volt). The reduction potential is represented by the absolute value of the potential at the current peak (the first peak when two or more peaks are present).

Any organic compound is useful in the present invention without any special limitation, provided that the organic compound has the reduction potential of 0.5 V or lower as measured by the above measurement method. Preferable are, however, those uniformly soluble in an organic solvent and a binder resin in view of the film-forming properties and uniformity of the formed layer. The amount of the organic compound used is in the range of preferably from 0.1 to 100%, more preferably from 0.5 to 50% by weight of the binder resin.

Preferred examples of the organic compounds having a reduction potential of 0.5 V or lower are shown together with the measured reduction potentials in Table 1.

TABLE 1

| Compound example No. | Structural formula | Reduction potential (V) |
|---|---|---|
| 1 | 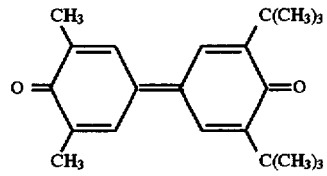 | 0.48 |
| 2 | 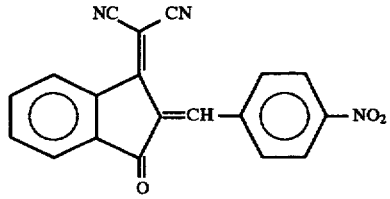 | 0.37 |
| 3 | 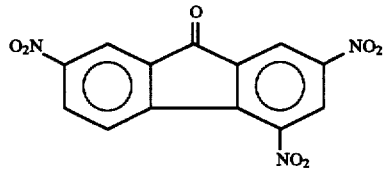 | 0.50 |
| 4 | 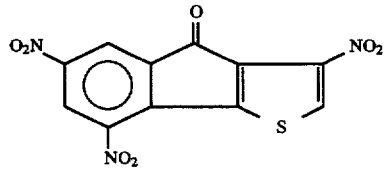 | 0.42 |
| 5 | 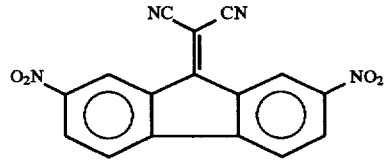 | 0.30 |
| 6 | 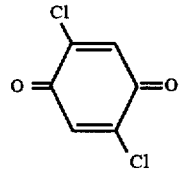 | 0.25 |

TABLE 1-continued

| Compound example No. | Structural formula | Reduction potential (V) |
|---|---|---|
| 7 | 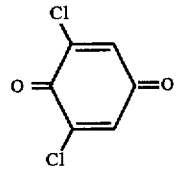 | 0.22 |
| 8 | 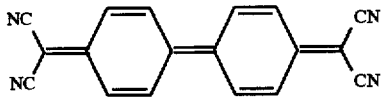 | 0.22 |
| 9 | 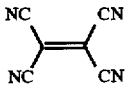 | 0.29 |
| 10 | 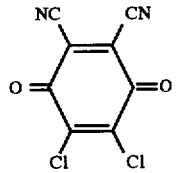 | 0.30 |
| 11 | 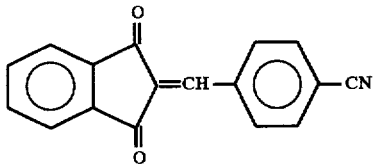 | 0.46 |

The binder resin for the surface layer in the present invention is not limited specially, and includes polyester resins, polycarbonate resins, polystyrene resins, acrylic resins, fluororesins, cellulose, polyurethane resins, epoxy resins, silicone resins, alkyd resins, vinyl chloride resins, and vinyl chloride-vinyl acetate copolymer resins.

The surface layer in the present invention may contain an additive such as an antioxidant, and a UV absorber, if necessary.

Next, the charging member in the present invention is explained.

The charging member may be in a shape of a roller, a blade, a brush, or an electroconductive powder or liquid which comes into contact with the surface of the electrophotographic photosensitive member. The material for constructing the charging member is not specially limited, and includes metals such as gold, silver, and mercury; resins containing an electroconductive powdery matter such as carbon black dispersed therein; electroconductive polymers, ion conductivity-treated rubber materials, and powdery magnetic materials.

For charge injection improvement, a larger contact area between the charging member and the surface of the electrophotographic photosensitive member is preferable. Therefore, the charging member is preferably in a form of a brush, a liquid or a powder. In consideration of easy handling in practical use, the powdery matter is preferred to the liquid matter. In particular, in view of the uniformity of charging and the ease of handling, a preferable charging member is constituted of a powdery magnetic material clustering in a brush shape around a magnet bar. The charging member in a roller or brush shape is preferably brought into contact with the electrophotographic photosensitive member and rotated at a different peripheral speed to increase the contact area of the charging member with the surface of the photosensitive member and to improve the charge injection. Preferably, the charging member and the photosensitive member are rotated in opposite directions at the contact portion. The value of resistance of the charging member is preferably in the range of from $1\times10^4$ to $1\times10^9\Omega/cm^2$. The charging member having a value of resistance higher than $1\times10^9\Omega/cm^2$ tends to cause defective charging, whereas the charging member having a resistance value lower than $1\times10^4\Omega/cm^2$ tends to cause defective charging around pinholes on the photosensitive member, growth of the pinholes, or breakdown of the electroconductivity.

[Measurement of Resistance]

The resistance of the charging member is measured as described below.

The charging member is positioned in contact with an aluminum cylinder of 35 mm diameter to form a nip of 3 mm wide. DC voltage of 100 V is applied to the charging member at the voltage application portion (a portion to which a voltage is applied in a practical electrophotographic apparatus: for example, the metal core of the charging roller) from outside. The current flow between the charging member and the aluminum cylinder is measured. The resistance of the charging member is expressed by the equation below, $$\text{Resistance } (\Omega/cm^2) = \frac{100\ (V)}{I(A) \times \text{Nip area } (cm^2)}$$

where I(A) represents current intensity: Nip area ($cm^2$)=0.3 (cm)×[Contact length (cm) of charging member with aluminum cylinder]

The light exposure means, the developing means, the transfer means, the cleaning means, and other means which are necessary for a usual electrophotographic process are not limited at all in the present invention.

The present invention is described by reference to Examples.

EXAMPLE 1

The figure is a schematic drawing showing an example of an electrophotographic apparatus employing a process cartridge of the present invention. The electrophotographic apparatus in Example 1 is a laser beam printer.

In the figure, a drum-shaped electrophotographic photosensitive member 1 having a diameter of 30 mm is driven to rotate in the arrow direction at a peripheral speed of 100 mm/sec. A rotating brush roller (charging brush) 2 as the charging member is provided in contact with the photosensitive member 1. DC voltage of −700 V is applied from a charging bias power source S1 to the charging brush 2. Thereby, the surface of the photosensitive member 1 is nearly uniformly charged at −680 V by injection-charging. The charged surface of the photosensitive member 1 is exposed to a scanning laser beam L emitted from a laser beam scanner (not shown in the drawing). Thus an electrostatic latent image correspondent to an original image information is formed. The formed latent image is developed as a reversal toner image with a magnetic one-component insulating negative toner by means of a reversal development means 3.

A non-magnetic development sleeve **3*a* of 16 mm diameter containing a magnet inside is coated with the above negative toner. The toner-coated development sleeve 3*a* is set to keep a fixed distance of 300 μm from the surface of the photosensitive member 1, and rotated at the same speed as the photosensitive member 1. A development bias is applied to the rotating sleeve 3***a* from a development bias source S2. The voltage is composed of superposition of a DC voltage of −500 V and a rectangular AC voltage of frequency of 800 Hz and peak-to-peak voltage of 1600 V, and the development is conducted by jumping development.

A transfer material P (the recording medium) is fed from a paper-feeding section not shown in the drawing, with a prescribed timing into nip T (transfer section) between the photosensitive member 1 and a transfer roller 4 of medium resistance which is a contact transfer means in contact with the photosensitive member at a prescribed pressure. A transfer bias is applied to the transfer roller 4 from a transfer bias source S3.

In this Example, the transfer is conducted with a transfer roller 4 having a roller resistance of $5\times10^8\Omega/cm^2$ by application of a DC voltage of +2000 V. At the transfer section T, a toner image formed on the surface of the photosensitive member 1 is transferred by an electrostatic force and a pressing force onto the transfer material P introduced into the transfer section T. The transfer material P having received the toner image is separated from the photosensitive member 1, conveyed to a fixing means 5 (a thermal fixing type etc.) for toner image fixation, and then sent out of the apparatus as an image print or copy. After the toner image was transferred, the surface of the photosensitive member is cleaned by a cleaning means 6 to remove a remaining toner or other adhering matters.

In the electrophotographic apparatus in this Example, the photosensitive member 1, the charging member 2, the development means 3, and the cleaning means 6 are integrated into one process cartridge 20, which is freely detachable from the main body of the electrophotographic apparatus. The development means 3 or the cleaning means 6 is not necessarily required to be integrated into the cartridge.

The electrophotographic photosensitive member 1 in this Example employs an organic photoconductive material for negative charging. On an aluminum cylinder of 300 mm diameter having a surface roughened by anode oxidation to prevent moiré formation by laser beam projection, three layers formed on the aluminum cylinder as shown below.

The unit "part" is based on weight hereafter, unless otherwise stated.

In a mixed solvent composed of 260 parts of methanol and 40 parts of butanol, dissolved were 10 parts of alcohol-soluble nylon copolymer resin (average molecular weight: 29000), and 30 parts of methoxymethylated 6-nylon resin (average molecular weight: 32000). This solution was applied onto the aluminum cylinder by dip coating and dried to form a subbing layer of 1 μm thick.

Then, 4 parts of disazo pigment represented by the following structural formula:

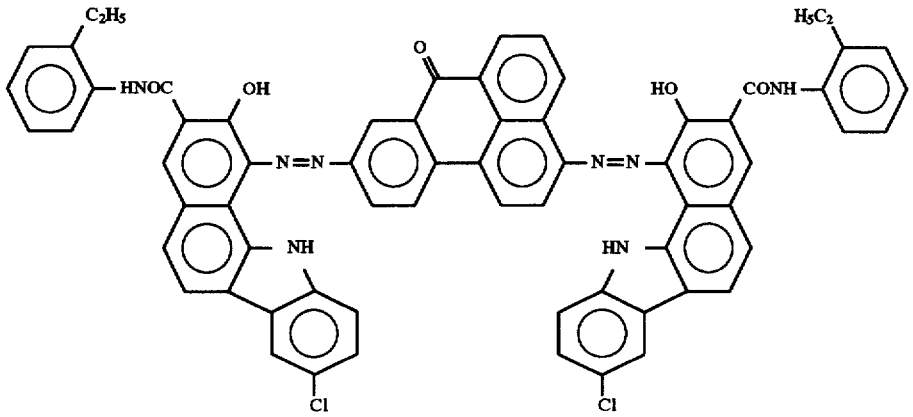

and 2 parts of a polyvinylbutyral resin (butyralation degree: 68%, average molecular weight: 24000) were dispersed in 34 parts of cyclohexanone by a sand mill for 12 hours to prepare a liquid dispersion for a charge-generating layer. This liquid dispersion was applied on the above subbing layer by dip coating and was dried to form a charge-generating layer of 0.2 μm thick.

Next, 7 parts of a hydrazone compound represented by the following structural formula:

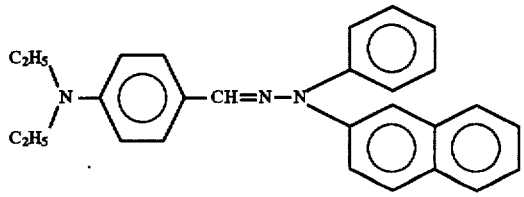

0.3 parts of Example Compound No. 5 shown in Table 1, and 10 parts of a polystyrene resin were dissolved in 50 parts of monochlorobenzene. This solution was applied on the above charge-generating layer by dip coating, and was dried to form a charge-transporting layer of 20 μm thick.

The charging brush 2, a charging member, was an electroconductive magnetic brush constituted of a non-magnetic electroconductive sleeve (not shown in the drawing), a magnetic roll 2*a* enclosed in the sleeve, and magnetic electroconductive magnetic particles on the sleeve. The magnetic roll is fixed and the sleeve and ears of magnetic particles (electroconductive magnetic brush) formed thereon are rotated together so as to move (peripheral speed: 150%) in a direction opposite to the movement of the photosensitive member at the contact portion. The particulate electroconductive magnetic material was particulate sintered magnetite having an average particle diameter of 20 μm. The resistance of the charging member was $5\times10^4\Omega/cm^2$ as measured by the aforementioned method.

Image output was carried out using the printer of the above-mentioned constitution. As a result, excellent image output was achieved. The voltage applied to the charging member 2 was just −700 volts, dispensing with extra voltage application which is required by a conventional contact charging device to cause discharge. Since discharge does not occur with charging, generation of ozone, as well as deterioration of the surface of the photosensitive member, is prevented.

EXAMPLE 2

An electrophotographic apparatus was prepared and evaluated in the same manner as in Example 1 except that Compound No. 8 in Table 1 was used in place of Compound No. 5, and the resistance of the charging member was adjusted to $3\times10^4\Omega/cm^2$ (adjusted by sintering temperature of the magnetite).

Consequently, the results were satisfactory as in Example 1.

EXAMPLE 3

An electrophotographic apparatus was prepared and evaluated in the same manner as in Example 1 except that Compound No. 9 in Table 1 was used in place of Compound No. 5, and the resistance of the charging member was adjusted to $5\times10^6\Omega/cm^2$ (adjusted by sintering temperature of the magnetite).

Consequently, the results were satisfactory as in Example 1.

EXAMPLE 4

An electrophotographic apparatus was prepared and evaluated in the same manner as in Example 1 except that Compound No. 6 in Table 1 was used in place of Compound No. 5, and the resistance of the charging member was adjusted to $7\times10^8\Omega/cm^2$ (adjusted by sintering temperature of the magnetite).

Consequently, the results were satisfactory as in Example 1.

EXAMPLE 5

An electrophotographic apparatus was prepared and evaluated in the same manner as in Example 1 except that 0.5 part of Compound No. 1 in Table 1 was used in place of 0.3 part of Compound No. 5, and the charging member was prepared as follows.

A tape having electroconductive rayon fibers (trade name: REC-C, Unitika Ltd.) in a brush state was spirally wound to a metal core 2*a* of 6 mm diameter to form the charging brush 2 as the charging member in this Example. The outer diameter of the brush was 14 mm. One brush filament was 600 denier/100 filaments. The density of the brush was 100,000 filaments per square inch. The resistance of the charging member was $1\times10^5\Omega/cm^2$.

The charging brush 2 was in contact with a photosensitive member 1 with a load of 50 g applied at the both ends of the metal core 2*a*, and was rotated at a peripheral speed of 150% in a direction counter to the movement of the photosensitive member at the contact portion. The surface of the photosensitive member was electrically charged by application of voltage of −700 V to the charging brush.

The results were satisfactory as in Example 1.

Comparative Example 1

An electrophotographic apparatus was prepared and evaluated in the same manner as in Example 1 except that Compound No. 5 was not included.

Consequently, the surface of the photosensitive member was hardly charged, and the formed image had dark fogging throughout.

Comparative Example 2

An electrophotographic apparatus was prepared and evaluated in the same manner as in Example 1 except that Compound No. 5 was replaced by the compound of the structural formula below (reduction potential: 0.62 V).

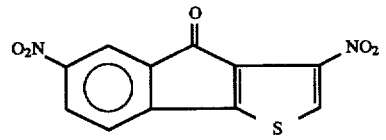

As a result, the surface of the photosensitive member was not charged sufficiently, and the formed image had many black spots.

EXAMPLE 6

A surface layer was formed on the same photosensitive member as used in Comparative Example 1 as follows.

In a mixture of 100 parts of toluene and 200 parts of methylcellosolve, dispersed were 60 parts of an acrylic monomer of the following structural formula and 10 parts of 2-methylthioxanthone (a photopolymerization initiator) using a sand mill for 48 hours.

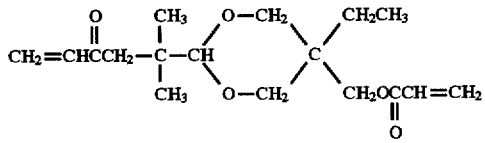

Thereto, 10 parts of Compound Example No. 3 in Table 1 was dissolved to obtain a liquid mixture for the surface layer. This mixture was applied by spray coating onto a photosensitive member as prepared in Comparative Example 1, followed by drying and irradiation with light from a high-pressure mercury lamp at an intensity of 8 $mW/cm^2$ for 20 seconds to form a surface layer of 3 μm thick.

An electrophotographic apparatus was prepared and evaluated in the same manner as in Example 1 except that the above photosensitive member was used.

The results were satisfactory as in Example 1.

What is claimed is:

1. An electrophotographic apparatus comprising an electrophotographic photosensitive member, a charging member provided in contact therewith for charging the electrophotographic photosensitive member by being applied with a voltage, a light exposure means, a developing means, and a transfer means, wherein the electrophotographic photosensitive member has a surface layer containing an organic compound having a reduction potential of 0.5 V or lower, and the charging is injection charging.

2. An electrophotographic apparatus according to claim 1, wherein the surface layer contains further a resin.

3. An electrophotographic apparatus according to claim 2, wherein the organic compound is dissolved in the resin.

4. An electrophotographic apparatus according to claim 1, wherein the electrophotographic photosensitive member comprises a substrate, and a photosensitive layer formed on the substrate, and the photosensitive layer is the surface layer.

5. An electrophotographic apparatus according to claim 1, wherein the electrophotographic photosensitive member comprises a substrate, a photosensitive layer formed on the substrate, and a surface layer formed on the photosensitive layer.

6. An electrophotographic apparatus according to claim 1, wherein the charging member has a value of resistance ranging from $1\times10^4$ to $1\times10^9$ $\Omega/cm^2$.

7. A process cartridge comprising an electrophotographic photosensitive member, a charging member provided in contact therewith for charging the electrophotographic photosensitive member by being applied with a voltage, the electrophotographic photosensitive member and the charging member being supported in one unit detachable from an electrophotographic apparatus, wherein the electrophotographic photosensitive member has a surface layer containing an organic compound having a reduction potential of 0.5 V or lower, and the charging is injection charging.

8. A process cartridge according to claim 7, wherein the surface layer further contains a resin.

9. A process cartridge according to claim 8, wherein the organic compound is dissolved in the resin.

10. A process cartridge according to claim 7, wherein the electrophotographic photosensitive member comprises a substrate, and a photosensitive layer formed on the substrate, and the photosensitive layer is the surface layer.

11. A process cartridge according to claim 7, wherein the electrophotographic photosensitive member comprises a substrate, and a photosensitive layer formed on the substrate, and a surface layer formed on the photosensitive layer.

12. A process cartridge according to claim 7, wherein the charging member has a vale of resistance ranging from $1\times10^4$ to $1\times10^9$ $\Omega/cm^2$.

13. A process cartridge according to claim 7, wherein the process cartridge has at least one of a developing means and a cleaning means.

* * * * *